United States Patent [19]

Crump

[11] 3,955,201

[45] May 4, 1976

[54] RADAR RADOME ANTENNA WITH SWITCHABLE R.F. TRANSPARENCY/REFLECTIVITY

[76] Inventor: Lloyd R. Crump, 12108 Atherton Drive, Silver Spring, Md. 20902

[22] Filed: July 29, 1974

[21] Appl. No.: 492,664

[52] U.S. Cl. ..... 343/701; 343/100 R; 343/837; 343/872

[51] Int. Cl.[2] ..... H01Q 1/42; H01Q 3/16

[58] Field of Search ..... 343/701, 823, 833, 834, 343/837, 854, 100 R, 872

[56] References Cited

UNITED STATES PATENTS

| | | | |
|---|---|---|---|
| 1,860,123 | 5/1932 | Yagi | 343/833 |
| 2,210,666 | 8/1940 | Herzog | 343/701 |
| 2,703,363 | 3/1955 | Rines et al. | 343/701 |
| 3,276,023 | 9/1966 | Dorne et al. | 343/754 |
| 3,392,393 | 7/1968 | Spitz | 343/754 |
| 3,623,109 | 11/1971 | Neumann | 343/819 |

*Primary Examiner*—Eli Lieberman
*Attorney, Agent, or Firm*—R. Sciascia; R. Beers; S. Scheinbein

[57] ABSTRACT

Control of the directivity, reflectivity, transparency and tuning of R.F. antenna array is accomplished by building antenna with short dipole segments with a switch between each two segments. The elements are properly connected to exhibit these electrical characteristics by remotely controlling the closing and opening of selected switches. The means for controlling the switches is isolated from the R.F. working frequencies of the antenna.

7 Claims, 8 Drawing Figures

RADAR RADOME ANTENNA WITH SWITCHABLE R.F. TRANSPARENCY/REFLECTIVITY

STATEMENT OF GOVERNMENT INTEREST

The invention described herein may be manufactured and used by or for the Government for governmental purposes without payment to me of any royalty thereon.

BACKGROUND OF THE INVENTION

This invention relates to R.F. antennas and especially to remote switching of antenna segments for antenna tuning, beam forming, and directing of antenna beams.

Present technique for tuning a T.V. antenna involves cutting it to the correct size for the frequency to be received or to a compromise size, if the antenna is to be used for more than one assigned frequency. Antenna beam forming is accomplished with a fixed antenna aperture and directivity is accomplished by mechanical rotation of the fixed array. Present techniques do not include means for automatically tuning and directing a stationary antenna array to various T.V. stations.

In the field of radar, beam forming involves a large antenna aperture and may also involve scanning a large antenna reflector which is very heavy. The resulting mechanical system is subject to wear and costly maintenance.

SUMMARY OF THE INVENTION

The present invention employs remotely controlled switching to alter the electrical configuration of electrically isolated antenna segments whereby the reflectivity or transparency of the configuration is changed. Predetermined element geometries also determine whether the switched configuration of a given member will tune it for a predetermined frequency or will make it a reflector or director at a predetermined frequency.

OBJECTS OF THE INVENTION

An object of this invention is to control the R.F. transparency of an antenna by remotely controlled switching which is isolated from the antenna R.F. working frequencies.

Another object is to control the directivity and reflectivity characteristics of antenna members by remotely controlled switching which is isolated from the antenna R.F. working frequencies.

A further object is to control the tuning of antenna members by remotely controlled switching which is isolated from the antenna R.F. working frequencies.

Other objects, advantages, and novel features of the present invention will become apparent from the following detailed description of the invention when considered in conjunction with the accompanying drawings.

DETAILED DESCRIPTION OF THE INVENTION

Figure 1:
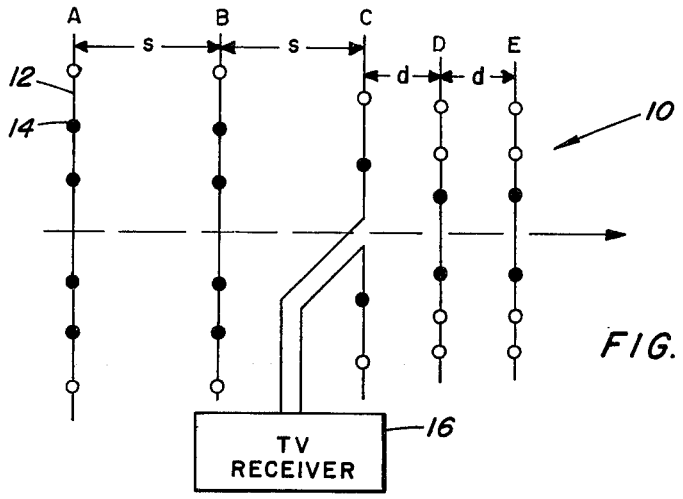
FIG. 1 is a schematic diagram of a "STAR" antenna in accordance with the invention. (The word "STAR" hereinafter used is an acronym for "switchable transparency and reflectivity" and is a good description of antennas which embody the present invention).

FIG. 1 shows schematically a STAR (switchable transparency and reflectivity) antenna 10 comprising wave-reflecting members, or reflectors, A and B, active member C and wave directing members or directors, D and E. (Member C will be called the "active" member whether the array is a receiving or transmitting antenna; it is the member which is connected to the receiver 16 or to the output of a transmitter). Each member is composed of a number of dipole segments 12 which are separated by switches 14. (An open circle denotes an open switch; a filled circle denotes a closed switch). For convenience, the active element C is shown with only 2 switches and four dipole segments; different members of dipole segments and switches can be employed as desired (see FIG. 2, for example).

Referring to FIG. 1, let us suppose that it is desired to receive channel 7 on our television receiver 16 and that our active member C is dimensioned so that it is tuned to the frequency of channel 7 when four dipole segments 12 are connected. The inner two switches on the active member C are closed to provide the proper length for the active R.F. feed element.

Good directivity is provided when the spacing (d) between the active member C and the directors is between 0.2 and 0.9 wavelength and the director elements D and E are shorter than the feed element or between 0.3 and 0.4 wavelength. Of course, increasing the number of directors will increase antenna gain and directivity.

Good reflectivity is provided when the spacing (s) between the active member C and the reflectors A and B is between 0.2 and 0.9 wavelength and the reflectors A and B are longer than the feed element or between 0.6 and 0.9 wavelength.

The length of segments 12 that make up each antenna member must be short enough to become transparent to R.F. signals of interest when disconnected and the length is adjusted to become effective in accordance with above overall element length requirement when segments are connected. The exact length of each segment will depend on design factors of each antenna; however, segment 12 length of approximately 0.1 wavelength is reasonable as shown in FIG. 1.

Uniform spacing of antenna elements is shown in FIG. 1; however other spacing configurations can be used in accordance with standard antenna design techniques.

Figure 2:
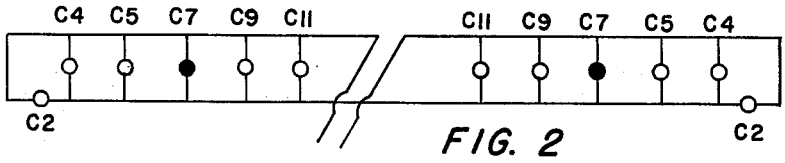
FIG. 2 is a schematic diagram of a member of a folded dipole, star antenna section showing method for tuning the active feed element.

FIG. 2 shows a front view of an active member for a folded dipole star antenna in which the segments are dimensioned differently. Here, if channel 7 tuning is desired the related pair of switches (C7) on either side of the R.F. feed are closed to complete the R.F. loop circuit. If channel 2 is desired, only the C2 switches are closed.

Control of switches (14) for selective connection of the antenna segments can be accomplished in various ways without the use of control leads for energizing each switch. If control leads are used the leads must be isolated from the antenna R.F. working frequencies to prevent the leads from effectively becoming part of the antenna array. Actual switching must be accomplished with very short connection means between segments without another R.F. path since another R.F. path would become part of the antenna. The normal way to accomplish this requirement would be with R.F. isolated switches having remote control means such as a light beam or R.F. energy that provides a high R.F. impedance return path to the control means. This method of switching can be accomplished with R.F. energy or light and photodiodes; infrared light, and infrared-sensitive photodiodes; or electrical switching signals fed to SCR diodes. When R.F. energy is employed, the control frequency should be considerably lower on higher than the R.F. frequency signal to be received or sent by the antenna (i.e., the antenna R.F. working frequency) in order to avoid any R.F. interference between the desired signal and control signal. Thus, the use of any terms herein similar to "means isolated from the R.F. working frequencies" refers to the fact that the "means" does not act as a director or reflector for the R.F. frequencies radiated or received by the antenna. The present invention R.F.-isolates the lines controlling the switches when control lines are used (e.g., FIG. 3), or uses inherently R.F.-isolated switch-activation means such as light beams or R.F. radiation sources of different frequency from the antenna R.F. working frequencies (e.g., FIG. 5).

Figure 3:
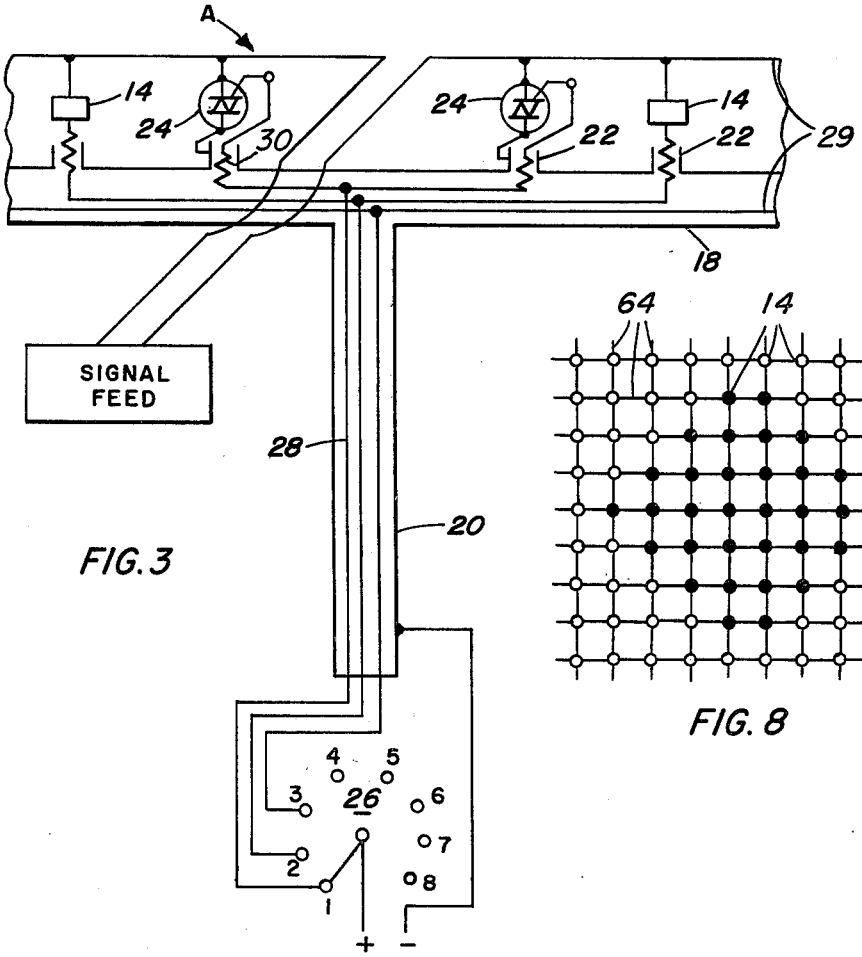
FIG. 3 is a partial diagram of the folded dipole star antenna section of FIG. 2 showing switch details.

Details of another method of switching using isolated control lines are shown in FIG. 3. The lower side 18 of the folded dipole antenna member or element, is fabricated to form a metallic pole as part of the supporting member 20. Small cylindrical pole segments 22 extend upwards from pole 18 for connecting to the top member of the folded dipole section 29. Each switch 14 may be, for example, a triac, which is a back-to-back pair of silicon controlled rectifiers (SCR), or triode thyristors, 24. To close this switch, a positive voltage of the proper value is connected through a multi-position selector switch 26 through a wire 28 to the gate terminal of the triac 24 via R.F. blocking resistor 30. (The positive voltage also goes to the first inner triac switch 24 via R.F. blocking resistor 30 on the other side of the signal feed point). The negative side of the switching voltage is connected to the support member 28, making it and the lower side 18 of the folded dipole member, as well as the cylindrical members 22, negative (or ground, if desired). The other triac switches, which are not shown, are connected in pairs to the selector switch 26. In position 1, only the first pair of triacs are energized; in position 2, the second pair of triacs are energized; and so on. The energized pair of switches completes the R.F. loop of a desired folded dipole (as shown in FIG. 2).

Figure 4:
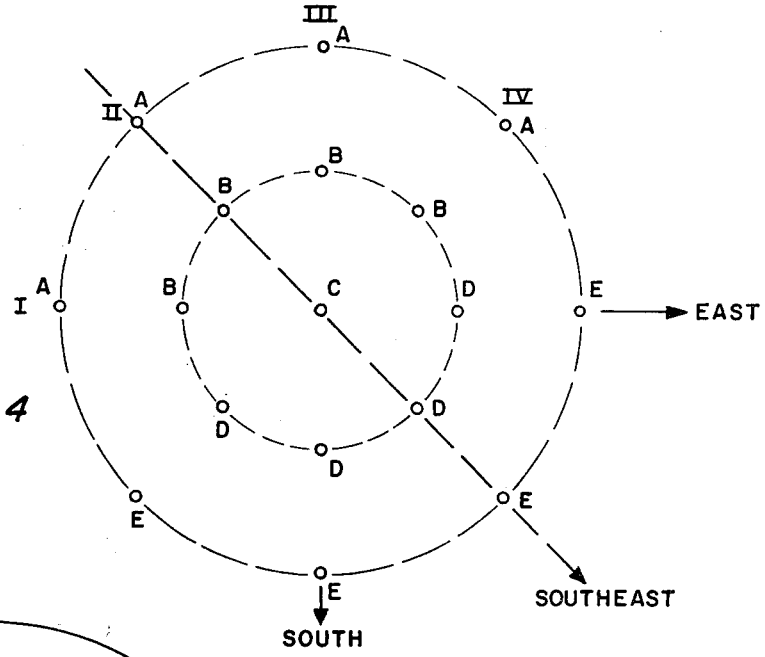
FIG. 4 is a top view of a vertically polarized, star antenna array for 360 degrees azimuth beam coverage.

FIG. 4 shows schematically a top view of a vertical polarized antenna array having 360 degrees azimuth coverage. Four or more antenna sections similar to the array of FIG. 1 are used (I, II, III, and IV). The same active element C is a common active dipole for all antenna sections. If the sections are vertically polarized, as shown, only one C member is required; if the members are horizontally polarized, two C members similar to the folded dipoles of FIG. 2 are employed and mounted at right angles to each other. To beam antenna array of FIG. 4 to the Southeast, antenna section II is energized with director D and E and reflectors A and B as shown. To redirect the beam to the Northwest, the elements are switched so that elements D and E become reflectors and A and B directors. Note that the array of FIG. 4 can be beamed in any azimuth direction by selective switching. With fast solid state switching, a scan rate of a MHz is possible.

By increasing the number of antenna sections and controlling two or more sections simultaneously, many antenna configurations are possible. For example, more directors can be added to the section array of FIG. 4 and additional section arrays can be added to the antenna array of FIG. 4. Two or more section arrays can be used simultaneously or independently. When operated simultaneously, the reflectors of section arrays I, II, III and IV act as a large antenna reflector aperture and the directors as a lens antenna array.

Figure 5:
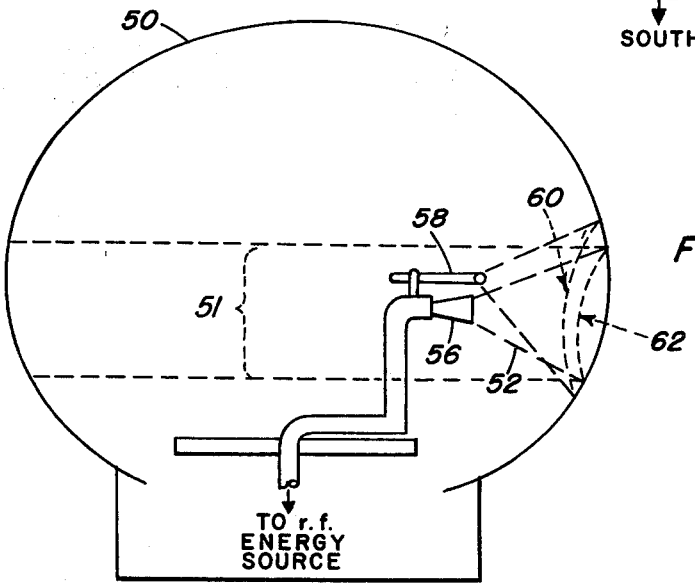
FIG. 5 is a schematic illustration of a radome with a feed horn and switch-activating means for control of randome wall transparency and reflectivity.
Figure 6:
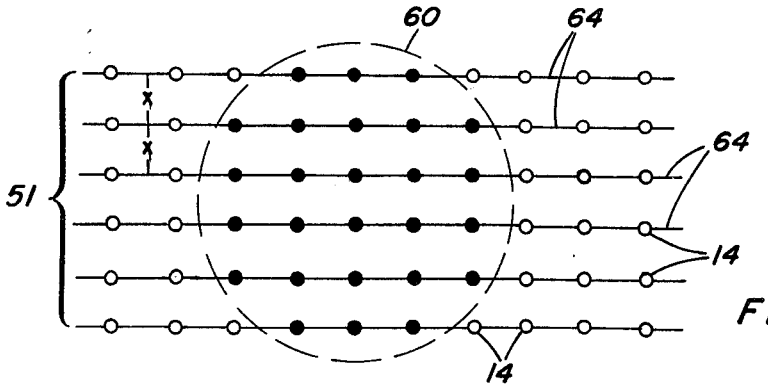
FIG. 6 is a schematic illustration of a possible grid structure for the radome of FIG. 5.

The concept of remotely controllable, switchable transparency, reflectivity and directivity can be applied to radar antennas. FIG. 5 shows a randome 50 which contains a metallic grid structure similar to the grid structure of FIG. 6. R.F. energy 52 is propagated through a feed horn 56 and irradiates an area of the radome 62. The switches 14 in the grid structure are energized by an energy source 58 which may be a light source, or a source of R.F. energy lower in frequency than the radar frequency. The energy source 58 is mechanically mounted on the rotating R.F. waveguide and feedhorn assembly and illuminates a predetermined area of the radome wall required for the desired radar antenna reflector. The illuminated area 60, shown in FIG. 6, activates light- or low-frequency R.F.-responsive switches 14 in the grid structure causing that area to become reflective to the radar R.F. energy (the R.F. working frequency). The switch-activating means 58 irradiates an area 60 which is either the same as or includes the area irradiated by the radar energy. The size and shape of the radome R.F. transparent wall structure 51, which constitutes a band around the radome, is designed to serve as the enclosure for the radar antenna reflector 62 and is designed to form and shape the desired radar R.F. beam pattern.

The R.F. transparent wall structure 51 is equipped with unconnected isolated grid segments 64 (see FIG. 6) which may be arranged in horizontal, spaced lines with a switch 14. The grid elements 64 and the spacing, x, between the rows of grid elements are dimensioned so that the grid segments, when connected by closed switches 14 (as in the irradiated area 60), act as reflectors and the isolated grid segments in the non-irradiated areas have very little effect on the radar energy or act as a lens antenna. Thus, the non-irradiated area of the radome is transparent and the irradiated (switch-activated) area is reflective to the radar energy. The remotely controlled switches 14 control the transparency directivity, and reflectivity of the radome antenna structure.

Figure 8:
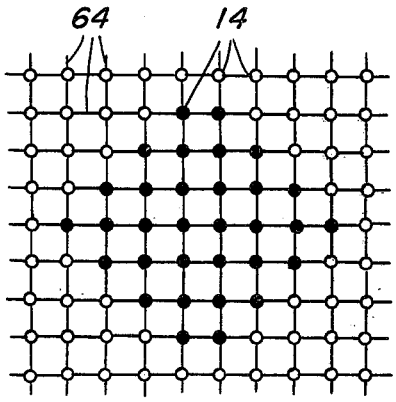
FIGS. 7 and 8 are schematic illustrations of other possible grid structures.
Figure 7:
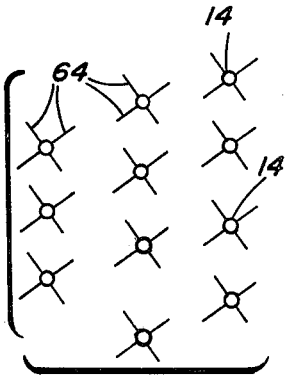

Other examples of grid structures include a cross-polarized antenna comprising isolated pairs of perpendicular grid elements (64 as shown in FIG. 7) and the horizontal and vertical polarized grid structure of FIG. 8. Each group of four grid elements is connected to a switch 14.

Other grid arrangements will suggest themselves to the reader.

The grids can be formed in portions of the radome which is made with an R.F. transparent material. The sections are then connected to each other to form the complete radome structure.

Since only the feed horn rather than the entire antenna need be rotated, the present invention:

a. provides a design technique for the construction of improved, large, stationary, radar antenna reflector systems;

b. provides low cost, lightweight, antenna rotation, tilt and stabilization control capabilities;

c. provides highly reliable radar antenna systems with low maintenance costs.

d. provides reflector-type radar antenna having high data rate (high scan rate) capability.

Obviously, many modifications and variations of the present invention are possible in light of the above teachings. It is therefore to be understood that, within the scope of the appended claims, the invention may be practiced otherwise than as specifically described.

What is claimed is:

1. An antenna system comprising:

a plurality of antenna segments arranged in a predetermined configuration, the lengths and spacings between the elements being predetermined also;

a plurality of switches, each connected between adjacent ends of at least two antenna segments, the normal condition of said switches being the open condition, said switches comprising light-responsive diodes;

remotely controlled means comprising light-generating means for selecting and closing a predetermined number of switches, the selection of switches determining at least one of the following characteristics of the antenna- tuning, reflectivity, directivity, and transparency, said selecting and closing means being isolated from the R.F. working frequencies of the antenna system.

2. A radar antenna comprising:

a curved section of R.F. transparent material, said curved section covering up to 360° in extent;

a plurality of grid segments carried by said transparent material and arranged in a predetermined configuration;

a plurality of switches, each connected between adjacent ends of at least two grid segments, the normal condition of said switches being the open condition; and remotely controlled means for selecting and closing the switches within a predetermined area so that said area becomes a reflector of radar energy, said selecting and closing means being isolated from the R.F. working frequencies of the antenna.

3. A radar antenna as in claim 2, wherein said curved section is part of a radome.

4. A radar antenna as in claim 2, said switches comprising solid-state switches controllable by electric signals and said remotely controlled means comprising means for supplying said electric signals.

5. A radar antenna as in claim 2, said switches comprising light-responsive diodes and said remotely controlled means comprising light-generating means.

6. A radar antenna as in claim 2, wherein said means for selecting and closing switches is operable to select and close different groups of switches in sequence to scan the antenna beam.

7. A radar antenna as in claim 6, wherein the scanning angle covers a full 360° in azimuth.

* * * * *